US005295683A

United States Patent [19]

Tate

[11] Patent Number: 5,295,683

[45] Date of Patent: Mar. 22, 1994

[54] GOLF DIVOT TOOL WITH BALL MARKER

[76] Inventor: John Tate, 14535 Firestone Blvd., La Mirada, Calif. 90638

[21] Appl. No.: 959,976

[22] Filed: Oct. 13, 1992

Related U.S. Application Data

[63] Continuation-in-part of Ser. No. 821,033, Jan. 16, 1992.

[51] Int. Cl.[5] ..... A63B 69/36

[52] U.S. Cl. ..... 273/32 A; 224/918

[58] Field of Search ..... 273/32 A, 32 B, 32 C, 273/32 D, 32 E; 224/247, 252, 918

[56] References Cited

U.S. PATENT DOCUMENTS

| | | | |
|---|---|---|---|
| 3,298,579 | 1/1967 | Smith | 224/918 |
| 3,744,542 | 7/1973 | Stephens | 224/918 |
| 3,923,215 | 12/1975 | Suzuki | 224/918 |
| 3,938,805 | 2/1976 | Sukuma | 224/918 |
| 4,998,726 | 3/1991 | Budnick | 273/32 B |

FOREIGN PATENT DOCUMENTS

| | | | |
|---|---|---|---|
| 2645756 | 10/1990 | France | 273/32 A |
| 1441154 | 6/1976 | United Kingdom | 273/32 A |

*Primary Examiner*—Theatrice Brown

*Attorney, Agent, or Firm*—Charles H. Thomas

[57] ABSTRACT

A golf accessory in the form of a divot tool is provided with a removable golf ball marker. The divot tool has a thin, expansive body and a pair of elongated generally parallel legs extending therefrom. A shallow, concave disk shaped, ball marker seat is defined on one surface of the divot tool body and an aperture is defined entirely through the structure of the body at the center of the ball marker seat. An annular disk of magnetic material, such as rubber in which particles of iron have been embedded, may be permanently secured to the floor of the ball marker seat. A ball marker having a disk shaped shield with a post projecting therefrom may be removably seated in the ball marker seat atop the magnetic material. The post extends entirely through the opening in the magnetic material and through the aperture in the body to project beyond the reverse surface. The ball marker may be ejected from the seat by pressing on the protruding portion of the post to push the shield out of the recessed ball marker seat in the body. The post on the ball marker also aids in maintaining the ball marker in position on a golf green when the ball marker is used for its intended purpose.

2 Claims, 1 Drawing Sheet

GOLF DIVOT TOOL WITH BALL MARKER

BACKGROUND OF THE INVENTION

This is a continuation-in-part of U.S. application Ser. No. 821,033 filed on Jan. 16, 1992.

FIELD OF THE INVENTION

The present invention relates to an improved golf accessory which can be utilized as a divot tool and which also includes a golf ball marker.

DESCRIPTION OF THE PRIOR ART

For a number of years different versions of golf divot tools which include a removable golf ball marker have been commercially available. Conventional golf accessory tools of this type are constructed with a flat, generally planar body having a pair of elongated generally parallel legs extending therefrom. A disk shaped cavity or recess is defined in one surface of the flat body, thereby creating a shallow, disk shaped tray. A thin slab of a magnetic material, such as rubber in which magnetic iron or iron oxide particles are embedded is permanently secured to the body of the divot tool at the bottom of the tray or recess defined therein.

In the conventional golf divot tools of this type the magnetic slab is typically shaped in the form of a circular disk, but with a segment removed. A flat, disk shaped ball marker is removably positionable in the disk shaped recess in the body atop the slab of magnetic material. The ball marker is normally held seated in position within the recess by the magnetic force with which the magnetic slab attracts the ball marker. The ball marker can be removed by inward pressure applied from the front of the tool toward the divot tool body at the edge of the ball marker adjacent the missing segment of the magnetic slab. Since there is a segment shaped cavity beneath the location at which pressure is applied on the ball marker, that portion of the ball marker is pushed into the cavity therebeneath. This force exceeds the force of magnetic attraction between the magnetic material and the ball marker, thereby tilting the opposite side of the ball marker out away from the magnetic material, and out of the recess in the divot tool body. The exposed edge of the ball marker can then be grasped between the thumb and forefinger and positioned as desired on a golf green.

SUMMARY OF THE INVENTION

The present invention represents an improved combination golf divot tool and ball marker assembly. According to the present invention a golf divot tool is formed with a body defining a ball marker seat and a ball marker removably disposed in the seat, as in prior divot tools of this type. However, according to the improvement of the invention an opening is defined through the structure of the body at the ball marker seat. The ball marker is formed with a post that extends through the opening within the body and projects beyond the opposite surface of the body when the ball marker is disposed in the ball marker seat.

The golf divot tool with the removable ball marker may be utilized with or without a magnetic material secured in the ball marker seat. When employed without the use of a magnetic material to hold the ball marker in position, the cross sectional area of the post extending from the ball marker shield must be such as to correspond to and snugly fit within the cross sectional area of the opening in the body of the divot tool. In this way the ball marker can be held in position within the ball marker seat by virtue of frictional engagement of the post within the opening defined through the structure of the body of the divot tool.

In all embodiments of the invention the post is of a sufficient length so that it projects beyond the side of the divot tool body opposite the ball marker seat when the ball marker is seated therein. In this way one can push the ball marker out of the ball marker seat by pressing from the rear of the divot tool on the exposed projecting end portion of the ball marker post toward the structure of the divot tool body. This pressure may be applied by merely pressing against the post toward the divot tool body using the ball of the thumb of one hand. The divot tool shield will then undergo translational movement outwardly away from the opposite side of the divot tool body and out of the ball marker seat where it can be seized between the thumb and forefinger of a golfer's hand.

The improved golf accessory of the invention can also be utilized with a magnetic material permanently disposed in the ball marker seat, as with prior devices. However, unlike prior devices the slab of magnetic material is of a flat, annular configuration and extends entirely across the floor of the recessed ball marker seat. The magnetic material has a central axial opening therethrough that resides in coaxial alignment with the opening in the divot tool body. The post of the ball marker projects through the coaxially aligned openings in both the magnetic material and the body of the golf divot tool when the ball marker is pressed into the ball marker seat.

As in embodiments without the magnetic material, the ball marker in an embodiment of a divot tool according to the invention employing a magnet may be removed from the ball marker seat by pressing on the exposed end of the post projecting beyond the divot tool body. Force is applied along the axis of the openings formed in the magnetic material and in the divot tool body at the floor of the ball marker seat. The ball marker will thereupon be forced out of the ball marker seat where it can be grasped and utilized.

The ball marker of the invention has a particular advantage over conventional ball markers. The ball marker post allows the ball marker of the golf accessory to be ejected easily from the ball marker seat in the golf accessory. Furthermore, the ball marker post also serves as a stabilizing peg or stake to prevent the ball marker from being inadvertently moved when the ball marker is in use. The post aids in holding the ball marker to the green and prevents it from being moved at all, even if hit by a golf ball during an approach shot or by some other object on a golf green.

The construction of the golf accessory of the invention provides a golf divot tool with a seat within which a ball marker may be firmly lodged, but from which the ball marker can be readily removed when desired. Preferably, the reverse side of the divot tool body is provided with an annular ring surrounding the opening therethrough to protect the projecting post from inadvertent dislodgement. The area on the reverse side on the ball marker surrounding the opening is preferably formed as a cup shaped depression extending between the opening and the surrounding ring so as to readily accommodate the configuration of the ball of the thumb of a golfer.

The golf ball marker is constructed of a flat, planar shield and the post extends outwardly perpendicular to the shield at its center. Preferably the golf ball marker seat and the ball marker shield are both of a disk shaped configuration. The ball marker has a back side from which the post projects and a front side or face bearing a distinctive indicia. The distinctive indicia may be the crest of a country club, a particular tournament, a golf association, the symbol or logo of some commercial enterprise, or any other decoration.

The invention may be described with greater clarity and particularity with reference to the accompanying drawings.

DESCRIPTION OF THE EMBODIMENT

Figure 1:
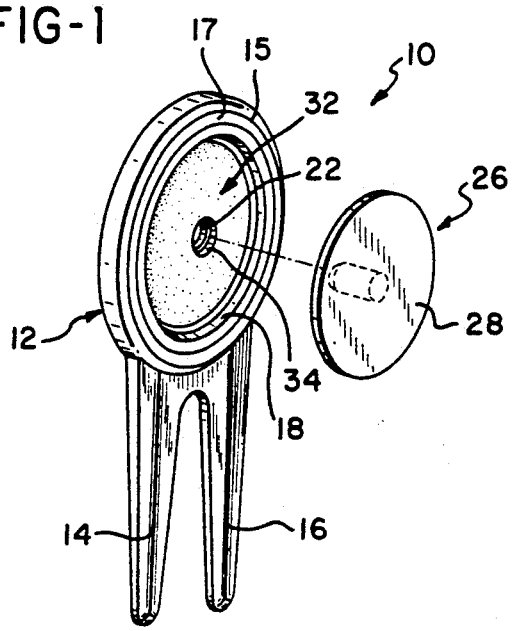
FIG. 1 is an exploded, perspective view of a preferred embodiment of the golf divot tool according to the invention.

FIG. 1 illustrates a golf divot tool 10 stamped of metal and formed with a generally disk shaped body 12. A pair of elongated generally parallel legs 14 and 16 extend from one peripheral edge of the thin, expansive body 12. The structure forming the body 12 and the legs 14 and 16 may be about two and one quarter inches in length and may be fabricated of brass, stainless steel, gold plated steel, or any other metal or non metallic material. As with conventional divot tools, the legs 14 and 16 of the divot tool 10 may be utilized to lift up grass that has been depressed on a golf green and otherwise in the replacement of divots in a conventional manner.

The body 12 has an obverse surface 15 and a reverse surface 24. The obverse surface 15 has a peripheral annular rim 16 therein which defines a shallow, concave tray or recess 18 that serves as a ball marker seat. The ball marker seat 18 is of a disk shaped configuration and has a flat, circular floor 20 with a small central circular aperture 22 defined therethrough. The aperture 22 may be about one eighth of an inch in diameter and is defined entirely through the structure of the body 12 and extends between the floor 20 of the ball marker seat 18 and the reverse surface 24 of the body 12.

A ball marker 26 is provided and has a disk shaped shield portion 28 with a short post 30 oriented perpendicular thereto. When the ball marker 26 is seated, the shield 28 resides snugly within the ball marker seat 18 and the post 30 extends through the opening 22 in the body 12 and projects from the reverse side 24 of the body 12, as depicted in solid lines in FIG. 2. The ball marker shield 28 has a back side 40 from which the post 30 projects and a face 42 which preferably bears a distinctive, decorative indicia, such as the crest of a country club, the official logo of a golf tournament, the logo or name of a golf association, or even the brand name or symbol of a commercial enterprise. The choice of the indicia to be placed on the disk shaped shield 28 is a matter of design preference.

As previously noted, the golf accessory of the invention may be utilized either with or without a magnet. In the embodiment depicted a slab 32 formed of a magnetic material is disposed in the ball marker seat 18 and is secured by adhesive to the floor 20 thereof. The magnetic slab 32 is formed as a circular, annular wafer or disk with a central axial opening 34 therethrough. The opening 34 in the magnetic slab 32 is coaxially aligned with the opening 22 through the structure of the body 12.

The body 12 is formed with a raised ring 36 that surrounds the opening 22 on the reverse surface 24 of the body 12 which is opposite the obverse surface 15 in which the ball marker seat 18 is formed. The area on the reverse side 24 between the surrounding ring 36 and the opening 32 forms a shallow, cup shaped concave depression 38 that readily accommodates the curvature of the thumb 40 of a user, depicted in FIG. 2.

The magnetic slab 32 is formed as a slab of rubber with magnetized ferrous particles or iron or iron oxide embedded therein. The ball marker 26 is formed of a ferrous material, such as soft steel. The iron in the steel disk 28 is attracted to the magnetic particles in the slab 32, so that once the ball marker 26 is seated in the ball marker seat 18, it is held therewithin by the force of magnetism acting on the shield 28. Alternatively, the magnetic slab 32 could be omitted and the ball marker 26 could be held in position in the ball marker seat 18 by the force of friction between the post 30 and the opening 22 in the body 12.

Figure 2:
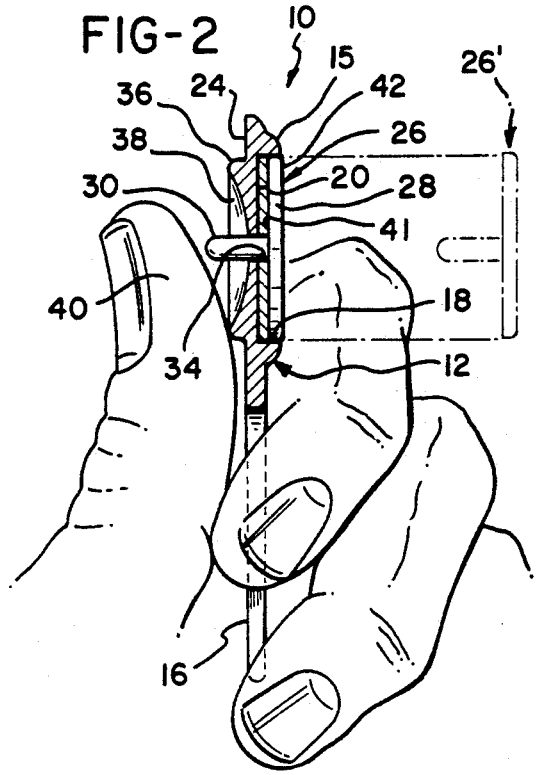
FIG. 2 is a side elevational sectional view of the golf divot tool of FIG. 1.
Figure 3:
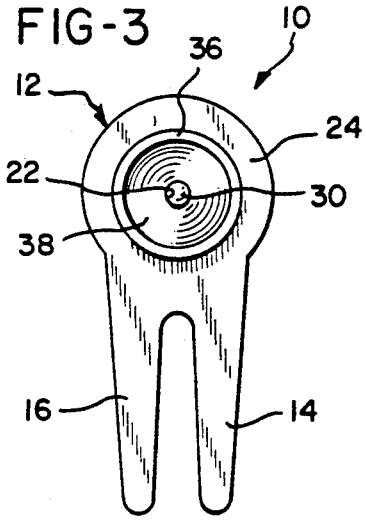
FIG. 3 is a rear elevational view of the golf divot tool of FIG. 1.
Figure 4:
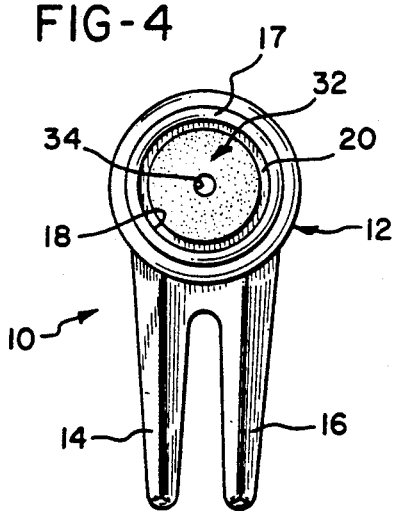
FIG. 4 is a front elevational view of the golf divot tool of FIG. 1 with the ball marker removed therefrom.

In either event the ball marker 26 may be inserted into the ball marker seat 18 from the position indicated at 26' in FIG. 2. The exposed tip of the post 30 is rounded, both to facilitate entry into the opening 22 and to prevent any injury to the thumb 40 of the golfer when the ball marker 26 is to be ejected. Once the ball marker 26 has been fully seated in the ball marker seat 18, as depicted in solid lines in FIG. 2, it will be held in the ball marker seat 18 by the force of magnetism from the slab 32 in the embodiment as illustrated. The ball marker post 30, the opening 34 in the slab of magnetic material 32, and the opening 22 in the body 12 of the divot tool 10 are all coaxially aligned. Also, the outer perimeter of the disk shaped portion 28 of the ball marker 26 is of a diameter which allows it to fit snugly within the walls of the ball marker seat 18.

To remove the ball marker 26 from the ball marker seat 18, a golfer merely presses with the thumb 40 of one hand against the rounded, exposed tip of the ball marker post 30 that projects beyond the reverse side 24 of the body 12. The force exerted with the thumb 40 easily overcomes the force of magnetism from the slab 32. The golfer pushes on the exposed end of the post 30 until the ball marker 26 is ejected from the ball marker seat 18, as indicated in phantom at 26' in FIG. 2.

Figure 5:
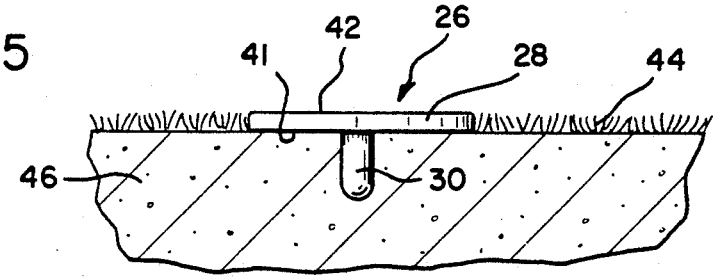
FIG. 5 is a side elevational detail showing use of the ball marker of the golf divot tool of FIG. 1.

FIG. 5 illustrates the use of the ball marker 26 on a golf green 44. It should be noted that the post 30, which is useful for ejecting the ball marker 26 from the body 12 of the divot tool 10 as illustrated in FIG. 2, also performs the function of stabilizing the position of the ball marker 26 on the golf green 44. The post 30 projects a short distance into the underlying soil 46 of the golf green 44. Thus, even if the ball marker 26 is struck by a golf ball dropping onto a green, such as sometimes occurs with an approaching chip shot or drive, the post 30 holds the ball marker 26 in the position in which it has been placed.

Undoubtedly, numerous variations and modifications of the invention will become readily apparent to those familiar with golf accessories. Accordingly, the scope of the invention should not be construed as limited to the specific embodiment depicted an described herein.

I claim:

1. In a golf accessory formed with a substantially flat body having a recessed cavity defined therein, a pair of legs extending from said body generally parallel to each other, a magnetic material disposed in said cavity and permanently secured to said body, and a ball marker constructed of a material attracted by magnetism and adapted to be removably seated in said cavity atop said magnetic material, the improvement wherein aligned openings are formed through said magnetic material and through said body at said cavity, said body is formed with raised ring surrounding said opening on a side of said body opposite said cavity, and said ball marker has a post which passes through said openings in said magnetic material and said body and projects beyond said body when said ball marker is seated in said cavity.

2. A golf accessory formed with a thin, expansive body and a pair of elongated generally parallel legs extending therefrom and wherein said body has observe and reverse surfaces and a peripheral rim on its obverse surface which defines a shallow, concave tray having a floor, and wherein an aperture is defined entirely through the structure of said body between said floor of said tray and said reverse surface of said body, and a raised ring is defined on said reverse surface of said body encircling said aperture therethrough, and further comprising a magnetic material secured in said tray and having an opening therethrough aligned with said aperture in said body, and a ball marker formed of a material attracted by magnetism and having a substantially planar shield and a post protruding therefrom, whereby said ball marker is adapted for removable seating in said tray atop said magnetic material with said post extending through said opening in said magnetic material and through said aperture in said body to project beyond said reverse surface.

* * * * *